US009518424B1

(12) United States Patent
Woodard et al.

(10) Patent No.: US 9,518,424 B1
(45) Date of Patent: Dec. 13, 2016

(54) POST FOR SWINGING AND CANTILEVER GATES

(71) Applicant: Alumi-Guard, Inc., Brooksville, FL (US)

(72) Inventors: William M. Woodard, New Port Richey, FL (US); Lawrence Peck, Brooksville, FL (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

(21) Appl. No.: 14/162,392

(22) Filed: Jan. 23, 2014

(51) Int. Cl.
*E06B 11/02* (2006.01)
*E04H 17/22* (2006.01)

(52) U.S. Cl.
CPC ..... *E06B 11/02* (2013.01); *E04H 17/22* (2013.01); *E05Y 2900/40* (2013.01)

(58) Field of Classification Search
CPC ..... E05Y 2900/40; E06B 11/00; E06B 11/02; E05D 2007/0453; E05D 15/00; E05D 15/02
USPC ..... 49/381, 504; 256/73, DIG. 5
See application file for complete search history.

(56) References Cited

U.S. PATENT DOCUMENTS

| | | | | |
|---|---|---|---|---|
| 1,277,844 | A | 9/1918 | Browne | |
| 3,531,895 | A | 10/1970 | Appell | |
| 4,366,649 | A | 1/1983 | Weigant | |
| 4,610,109 | A | 9/1986 | Ruigrok | |
| 4,628,638 | A | 12/1986 | Elko et al. | |
| 4,723,374 | A | 2/1988 | Peterson et al. | |
| 4,791,757 | A | 12/1988 | Orlando | |
| 4,830,531 | A * | 5/1989 | Condit et al. | 403/348 |
| 5,136,813 | A | 8/1992 | Gibbs et al. | |
| 5,345,723 | A | 9/1994 | Gibbs | |
| 5,385,383 | A | 1/1995 | Kreis et al. | |
| 5,564,775 | A * | 10/1996 | Ebert et al. | 296/202 |
| 6,751,907 | B1 | 6/2004 | De Gasperis | |
| 7,210,200 | B2 * | 5/2007 | Hoffman | 16/367 |
| 8,100,600 | B2 | 1/2012 | Blum | |
| 8,196,353 | B2 | 6/2012 | Loidolt | |
| 8,468,749 | B1 | 6/2013 | Dufresne | |
| 8,534,005 | B2 * | 9/2013 | Thomas et al. | 52/126.4 |
| 2005/0183238 | A1 * | 8/2005 | McCue et al. | 16/236 |
| 2012/0043434 | A1 | 2/2012 | Stull | |
| 2012/0090136 | A1 * | 4/2012 | Fields | 16/386 |
| 2014/0223827 | A1 | 8/2014 | Larsen | |

* cited by examiner

*Primary Examiner* — Brian Mattei
*Assistant Examiner* — Catherine A Kelly
(74) *Attorney, Agent, or Firm* — Maldjian Law Group LLC

(57) ABSTRACT

A hinge for a swinging gate includes a base plate, a hinge base pivotally secured to the base plate and a mounting member connected in spaced apart relation to the hinge base by an elongate bolt. A gate-engaging member is secured to the mounting member so that pivoting of the hinge base effects conjoint pivoting of the mounting member, the gate-engaging member and a gate that it engages. An upstanding post has a pair of laterally spaced apart T-shaped slots that extend along its height. A bolt disposed within a T-shaped slot is disposed horizontally and cannot rotate. The bolts housed in a T-shaped slot screw-threadedly engage apertures formed in the corners of the base plate to secure the base plate to the upstanding post. In a second embodiment, a cantilever gate supported by a trolley assembly is secured in cantilever relation to at least one upstanding post.

2 Claims, 7 Drawing Sheets

POST FOR SWINGING AND CANTILEVER GATES

BACKGROUND OF THE INVENTION

1. Field of the Invention

This invention relates, generally, to the construction of swinging and cantilever gates. More particularly, it relates to a post that facilitates mounting of both types of gates.

2. Description of the Prior Art

Swinging gates include a post to which hinges are mounted and the respective free ends of the hinges engage a gate that pivots about the hinge in a well-known way. Cantilever gates typically include two or more laterally spaced apart posts and each post supports an upper level track and a lower level track that are parallel to one another. Rollers are mounted to the gate and roll along the tracks to enable the gate to be displaced to the left or right.

Both types of gates require that two or more brackets be positioned along the vertical extent of the post or posts.

In a swing-type gate, a first bracket is typically mounted below the top end of the post and a second bracket is typically mounted above the bottom end of the post. The weight of the gate determines the optimal location of the brackets.

The positioning of brackets in a cantilever-type gate is similar. An upper bracket supports an upper track for at least one roller and a lower bracket supports a lower track for at least one roller. A lengthy cantilever-type gate can require multiple upper and lower brackets.

The mounting of brackets to posts can be time-consuming. Improperly positioned brackets cause gates to open and close in unacceptable ways Thus there is a need for a post to which brackets can be easily attached and which can be easily adjusted in position if such adjustment is required.

Some manufacturers make a first type of post for swing gates and a second type for cantilever gates.

Thus there is a need for an upstanding post that has utility for both types of gates so that gate installation companies need not maintain separate inventories of swing gate posts and cantilever gate posts.

There is also a need for an improved hinge for swinging gates and improved roller structures for cantilever gates.

However, in view of the art considered as a whole at the time the present invention was made, it was not obvious to those of ordinary skill in the art how the needed improvements could be provided.

SUMMARY OF THE INVENTION

The long-standing but heretofore unfulfilled need for an improved upstanding post, an improved hinge design for a swing gate and improved roller structures for a cantilever gate is now met by a new, useful, and non-obvious invention.

The inventive structure includes an improved post that facilitates the mounting of both swinging gates and cantilever gates thereto.

The post is preferably hollow but its hollow embodiment has two (2) laterally spaced apart corners, each of which is a vertical column formed of a solid material extending the entire vertical extent of the post. Each vertical column is integral with the flat front wall of the post and extends into a hollow interior of the post.

A T-shaped slot is formed in each vertical column of solid material and each slot extends the entire height of the post, i.e., each slot is in open communication with the uppermost end of the post and with the lowermost end as well. The "T" shape is seen when the post is viewed in top or bottom plan view, i.e., each slot is horizontally disposed with the short, crossbar part of the "T" being inboard of the post and the longer part of the "T" being in open communication with a front wall of the post.

The crossbar or short part of the "T" houses a tool-engageable head of a screw or bolt and said housing is shaped to prevent rotation of the nut. The long part of the "T" houses the threaded part of the screw or bolt but has less extent than the screw or bolt it houses so that a distal free end of such screw or bolt projects out of the T-shaped slot when the tool-engageable head is non-rotatably positioned in its housing. This enables an installer to screw-threadedly tighten a nut that is engaged to a screw or bolt without using a hand tool to prevent rotation of the tool-engageable head.

In a swing gate embodiment, a square or rectangular base plate has a screw or bolt-receiving aperture formed in each of its four corners. An installer places a screw or bolt through each aperture with the tool-engageable head thereof on the reverse side of the base plate, i.e., the side that will abut the post. A nut is then screw-threadedly engaged to each screw or bolt but the nut is not advanced all the way to the tool-engageable head. The distance between the nut and the tool-engageable head is greater than the length of the long part of the T-shaped slot.

A bolt, when disposed within a T-shaped slot, is disposed horizontally if the post is in an upstanding position. The base plate is held above the uppermost end of the post so that the screws are aligned with the T-shaped slots and the base plate is lowered so that said screws are slidingly received by their associated slots with the heads of the screws entering the cross bar part of the slot and the screw-threaded stems entering the long part of the slot. The length of the stems exceeds the length of the long part of the respective T-slots so that the distal free end of the stem projects out of their associated T-slots. The base plate can thus be positioned at any height along the extent of the post and the nuts can be tightened when the desired position is attained. If an adjustment of position is required, the nuts are easily loosened and re-tightened as needed.

In the swing gate embodiment, the base plate forms the base of a hinge. A first hinge post holder is formed integrally with the base plate at an uppermost end thereof, and a second hinge post holder is formed integrally with the base plate at a lowermost end thereof.

The first and second hinge post holders are vertically spaced apart from one another. A solid hinge base of parallelepiped structure is disposed between the first and second hinge post holders. A vertically-extending bore is formed in each of the first and second hinge post holders.

The hinge base also has a vertical bore formed in a first end thereof. The vertical bore is in axial alignment with the vertically-extending bores formed in the first and second hinge post holders. A hinge post has opposite ends rotatably received within the vertically-extending bores and that hinge post extends through the vertical bore formed in the hinge base so that the hinge base is hingedly connected to the base plate and can pivot one hundred eighty degrees (180°) with respect to the base plate.

An internally-threaded horizontal bore is also formed in the hinge base in normal relation to the vertical bore formed in the hinge base. A mounting member, also of solid, parallelepiped structure, has a horizontal bore disposed in axial alignment with the horizontal bore formed in the hinge base. An externally-threaded bolt has a tool-engageable head at a proximal end thereof. A medial extent of that bolt extends through the horizontal bore formed in the mounting member and a distal end of that bolt is in screw-threaded engagement with the horizontal bore formed in the hinge base. This enables adjustment of the spacing between the hinge base and the mounting member and it facilitates assembly of the gate structure as a whole. Moreover, pivotal movement of the hinge base causes conjoint pivotal movement of the mounting member.

The mounting member is securely attached to a square U-shaped gate-engaging member so that pivoting of the hinge base effects conjoint pivoting of the square U-shaped gate-engaging member and the gate that it engages.

A gate frame is received within a space defined by the square U-shaped gate-engaging member. A central aperture is formed in the square U-shaped gate-engaging member and a T-shaped slot is formed in a solid part of the gate frame. The slot is adapted to non-rotatably receive a screw or bolt the distal free end of which extends through the central aperture formed in the U-shaped gate-engaging member. A nut engages that distal end to secure the gate frame to the square U-shaped gate-engaging member.

A gate is secured to the gate frame. In a preferred embodiment, the gate is secured to a first gate frame near the upper end of the gate and to a second gate frame near the lower end of the gate. However, connecting a gate to a single gate frame member is within the scope of this invention, as is connecting a gate to more than two gate frame members.

A flange is formed in an edge of the base plate. The flange is normal to a plane of the base plate and is turned in an inward direction relative to an outward direction of the hinge post mounts. The flange serves to facilitate alignment of the upstanding post and each base plate.

The cantilever embodiment includes at least one upstanding post. A pair of T-shaped slots is formed in each upstanding post, just as in the first embodiment.

An angle bracket is secured to the at least one post near an upper end thereof and a roller is supported by the angle bracket. A guide frame secured to the cantilever gate includes an axle for rotatably holding the roller.

A trolley bracket is secured to a lower end of the at least one post.

A trolley assembly includes an elongate flat base plate to which a plurality of pairs of rollers is mounted, each roller having a horizontal axle for rotation in a vertical plane. A flat base plate is oriented in a vertical plane and each pair of rollers has members on opposite sides of the flat base plate.

The trolley assembly is housed within an elongate housing which includes inboard-turned flanges upon which the rollers ride. The gate is secured to the elongate housing in surmounting relation to the elongate housing. The flat base plate and the rollers are mounted to the trolley bracket so that the rollers rotatably engage the inwardly turned flanges of the elongate housing when the cantilever gate is displaced.

The novel trolley assembly may also include an auxiliary wheel mount secured to opposite ends of the flat base plate. Each auxiliary wheel mount supports a vertical axle and each vertical axle supports a horizontally mounted wheel that rotatably engages the elongate housing when the cantilever gate is displaced.

An important object of this invention is to provide a novel post that facilitates the attachment of swing and cantilever gates thereto.

Another important object is to provide a robust hinge that interconnects an upstanding post and a hingedly mounted gate that swings with respect to the upstanding post.

Still another important object is to provide a novel trolley assembly that facilitates the mounting of a cantilever gate to the novel upstanding post.

These and other objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
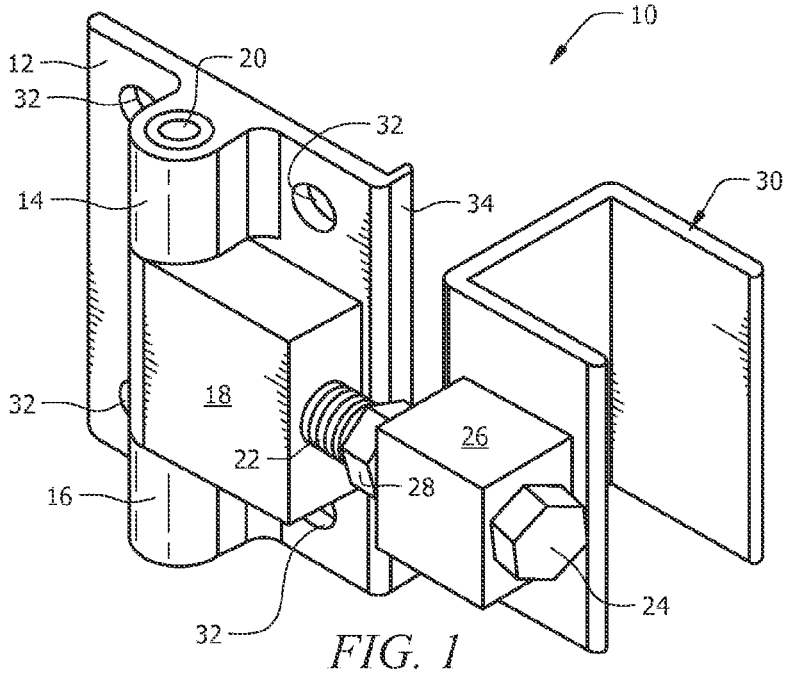
FIG. 1 is a perspective view of the novel structure.

FIG. 1 depicts an illustrative embodiment of the novel structure which is denoted as a whole by the reference numeral 10.

Novel hinge bracket 10 includes base plate 12 having first hinge post holder 14 and second hinge post holder 16, said hinge post holders being vertically spaced apart from one another. Hinge base 18 has a parallelepiped configuration and fits between said first and second hinge post holders. Said first and second hinge post holders 14, 16 are centrally bored to receive hinge post 20. A first end of hinge base 18 has a vertical bore formed therein that is in axial ant with the central bores formed in the hinge post holders so that said vertical bore receives said hinge post 20. Accordingly, hinge base 18 is hingedly connected to base plate 12 and can pivot one hundred eighty degrees (180°) with respect to said base plate 12.

An internally-threaded first horizontal bore, not provided with a reference numeral, is formed in hinge base 18 in normal relation to the vertical bore formed in said hinge base. That internally-threaded horizontal bore screw-threadedly receives the distal end of externally-threaded bolt 22 having tool-engageable head 24 at its proximal end. The medial extent of bolt 22 extends through a second horizontal bore formed in mounting member 26, also of parallelepiped structure, said second horizontal bore being in axial alignment with said first horizontal bore. Nut 28 enables adjustment of the distance between hinge base 18 and square mounting member 26 and provides conjoint pivotal displacement of hinge base 18 and mounting member 26.

Square mounting member 26 is securely attached to square U-shaped gate-engaging member 30. More particularly, a vertical wall of square mounting member 26 is welded to a vertical wall of square U-shaped gate-engaging member 30 as depicted in FIG. 1. Accordingly, pivoting of hinge base 18 effects conjoint pivoting of square U-shaped gate-engaging member 30 and the gate that it engages.

FIG. 1 also depicts four (4) apertures, collectively denoted 32, formed in base plate 12 near the respective corners thereof, and a flange 34 formed in an edge of base plate 12, said flange being normal to the plane of base plate 12 and turned in an inward direction relative to the outward direction of hinge post mounts 14, 16.

Figure 2:
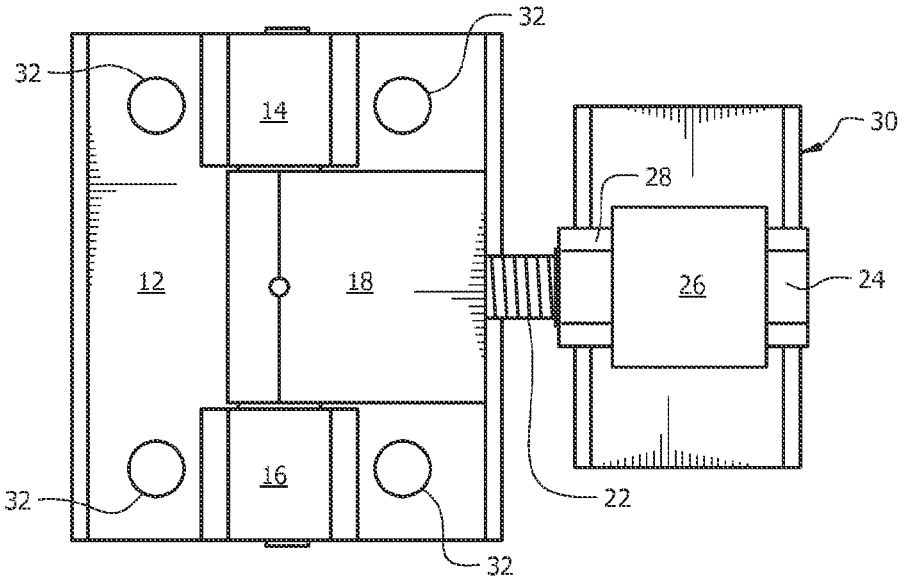
FIG. 2 is a front elevational view thereof.

The same parts are depicted in the front elevational view of FIG. 2.

Figure 3:
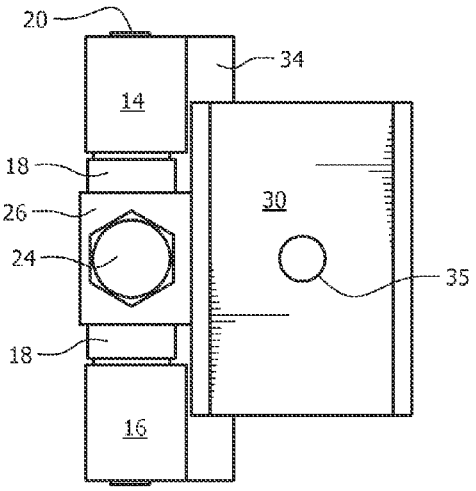
FIG. 3 is an end elevational view thereof.
Figure 4:
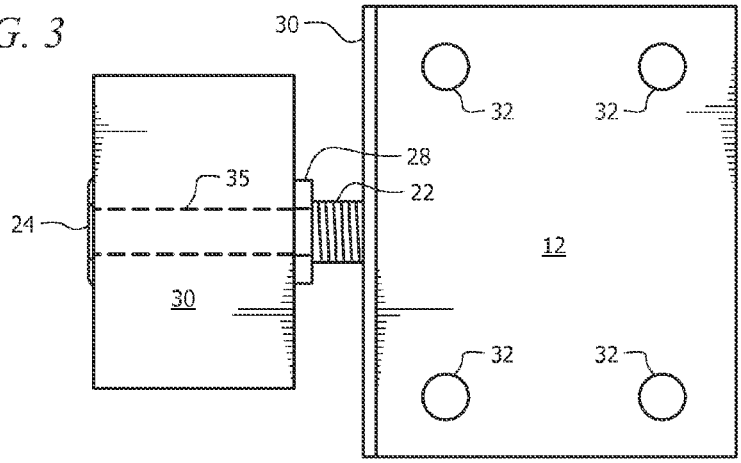
FIG. 4 is a rear elevational view thereof.

FIG. 3 depicts the parts of FIGS. 1 and 2 in end view and adds central aperture 35 formed in square U-shaped gate-engaging member 30. No additional parts arc depicted in the rear devotional view of FIG. 4.

Figure 5:
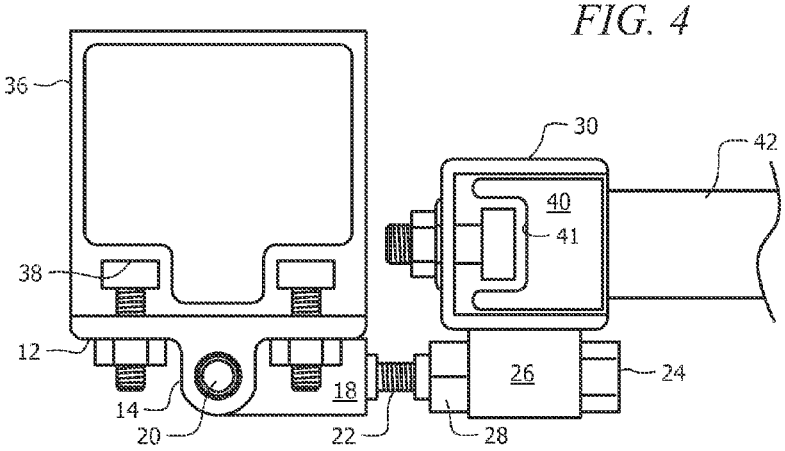
FIG. 5 is a top plan view thereof and is also a view taken along line 5-5 in FIG. 6.

The top plan view of FIG. 5 adds upstanding post 36 which may be of any height and which in a preferred embodiment is hollow, four inches (4") wide and four inches (4") in depth. It is referred to as a T-slot post because it has two (2) T-shaped slots, collectively denoted 38, that extend the entire vertical extent of the post and which are in open communication with the top and bottom ends of the post. Post 36 could be of solid construction but the preferred embodiment is hollow as depicted except in its forward or front corners where the T-shaped slots are formed.

As drawn in FIG. 5, the short, cross-bar section of each T-shaped slot receives the tool-engageable head of a nut or screw, not depicted, and prevents rotation of that head. The long section of each T-shaped slot receives the screw-threaded stem of the screw or bolt. The distal end of the screw or bolt extends outwardly from said long section and is engaged by a nut that is tightened to secure base plate 12 to post 36.

FIG. 5 also adds gate frame 40 which fits within square U-shaped gate-engaging member 30 within which is formed T-shaped slot 41. A screw or bolt fits within said slot in the same manner as it would in the slots formed in post 36. The distal end of the stem of such screw or bolt extends through central aperture 35 and a nut that engages said distal end secures gate frame 40 to square U-shaped gate engaging member 30.

Figure 6:
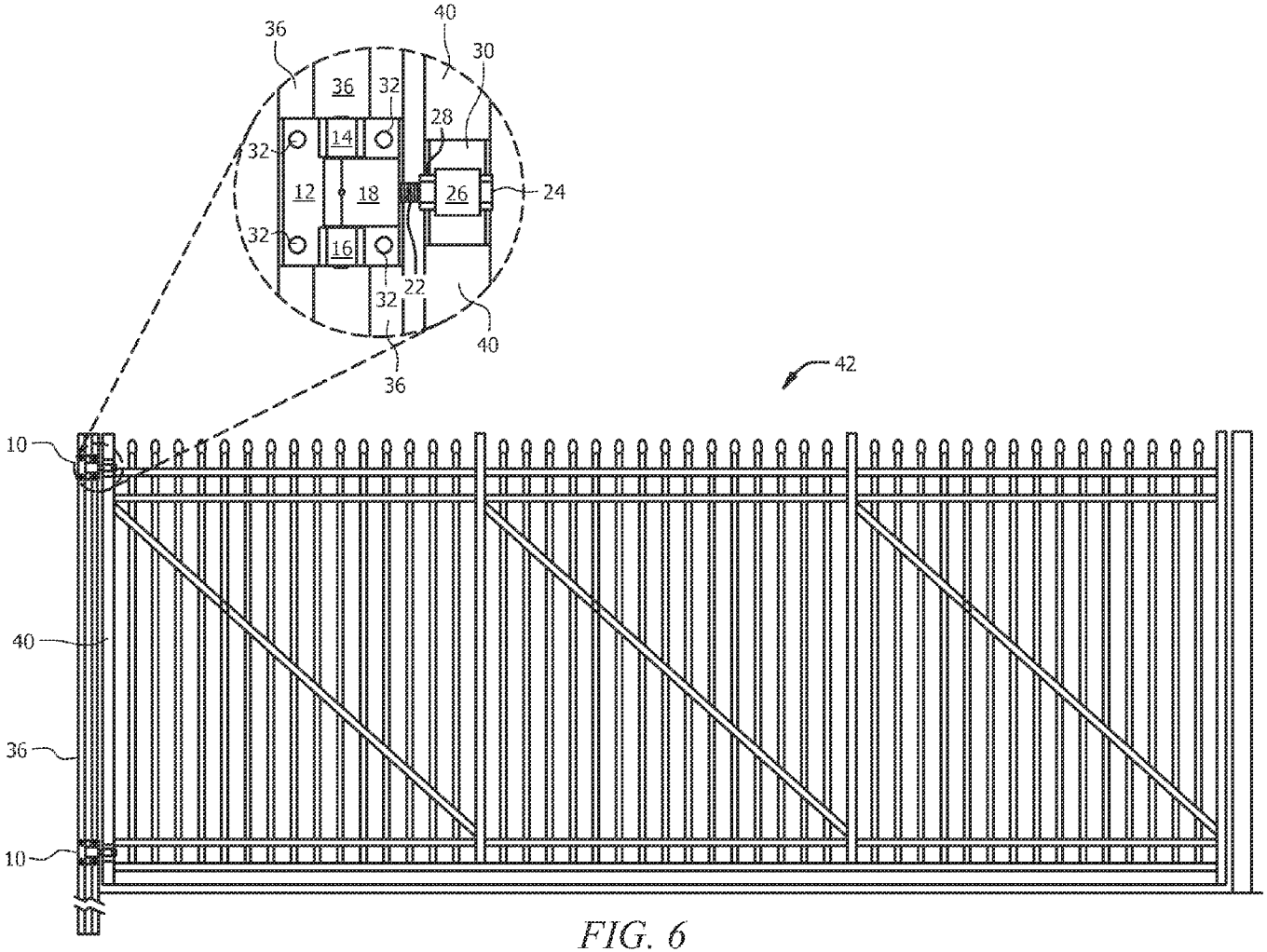
FIG. 6 is a front elevational view of a swinging gate mounted by the novel hinge.

FIG. 6 is a front elevational view of swing gate 42 which is mounted to first and second novel brackets 10 near an uppermost and lowermost end thereof as depicted, said gate 42 being welded at said brackets 10, 10 to gate frame 40. In FIG. 6, as depicted and as perhaps best understood in connection with FIG. 5, the screws that secure base plate 12 to post 36 are perpendicular to the plane of gate 42 when said gate is closed, i.e., said screws are perpendicular to the plane of the paper in said FIG. 6.

Figure 7A:
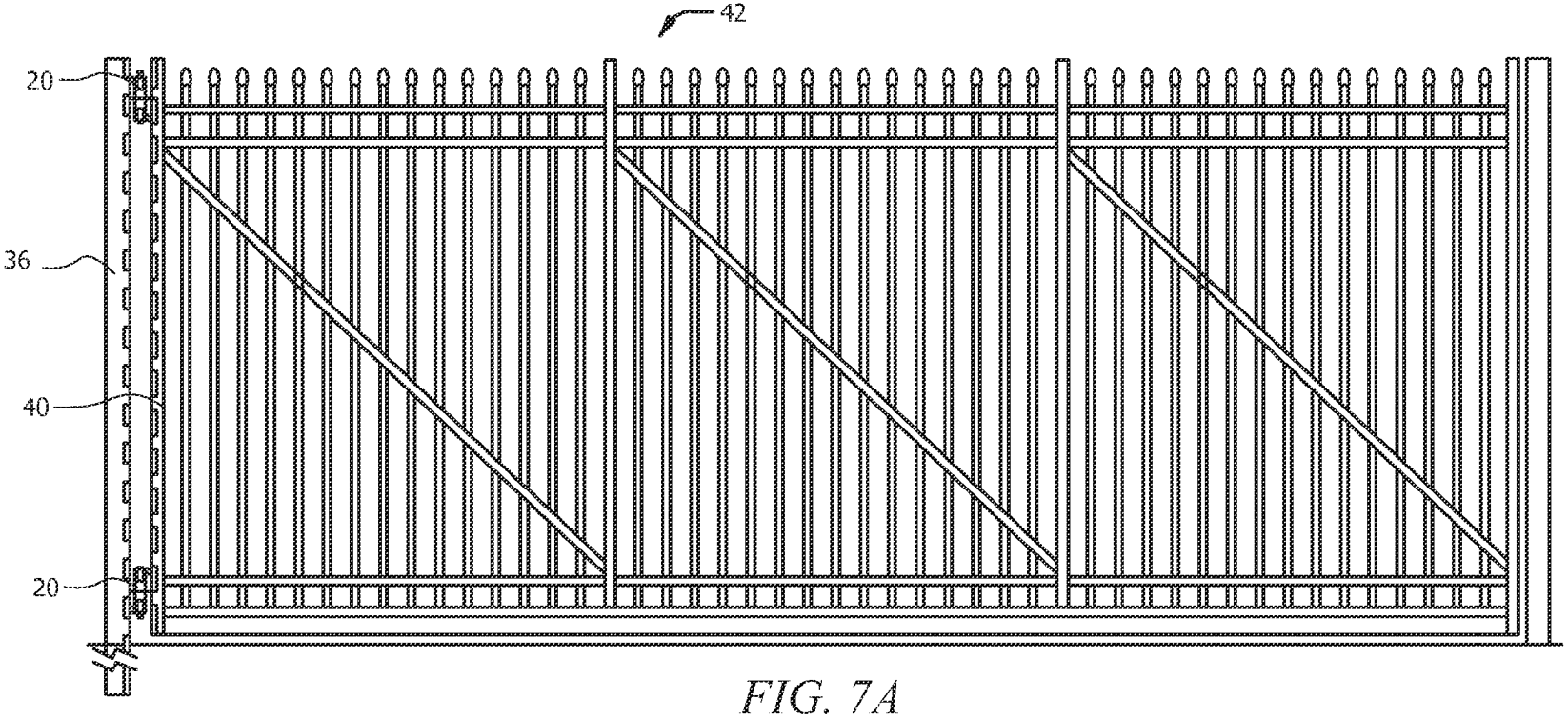
FIG. 7A is a front elevational view of a swinging gate mounted with a second embodiment of the novel hinge.
Figure 7B:
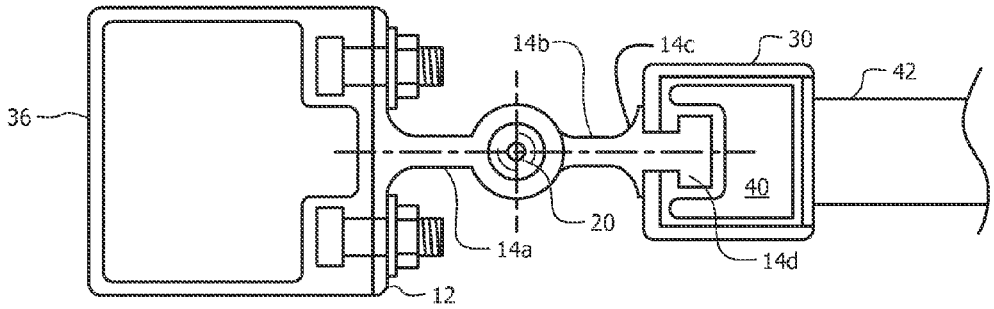
FIG. 7B is a top plan view of the second embodiment of the hinge.

FIGS. 7A and 7B depict a second orientation of novel T-slot post 36. In this embodiment, the screws that secure base plate 12 to post 36 are parallel to the plane of gate 42 when said gate is closed, i.e., said screws are in the plane of the paper in said FIGS. 7A and 7B.

As best understood in connection with FIG. 7B, base plate 12 includes T-slot post 36 as in the first embodiment, but hinge post holder 14 is elongated as at 14*a* and 14*b* on opposite sides of hinge post 20 in this embodiment and mounting member 26 is eliminated. Elongated part 14*b* has two (2) flanges, 14*c* and 14*d*. Flange 14*c* is welded to gate frame 40 and flange 14*d* is captured as depicted. Gate-engaging member 30 receives gate frame 40 which has a height substantially equal to the height of post 36.

This second embodiment increases the space between T-slot post 36 and gate-engaging member 30. Gate 42 of the first embodiment can swing one hundred eighty degrees) (180° relative to T-slot post 36 but gate 42 of the second gate 42 can swing open more than ninety degrees (90°) but as understood from an inspection of FIG. 5, such swing will be less than one hundred eighty degrees (180°) relative to said T-slot post 36.

Figure 8A:
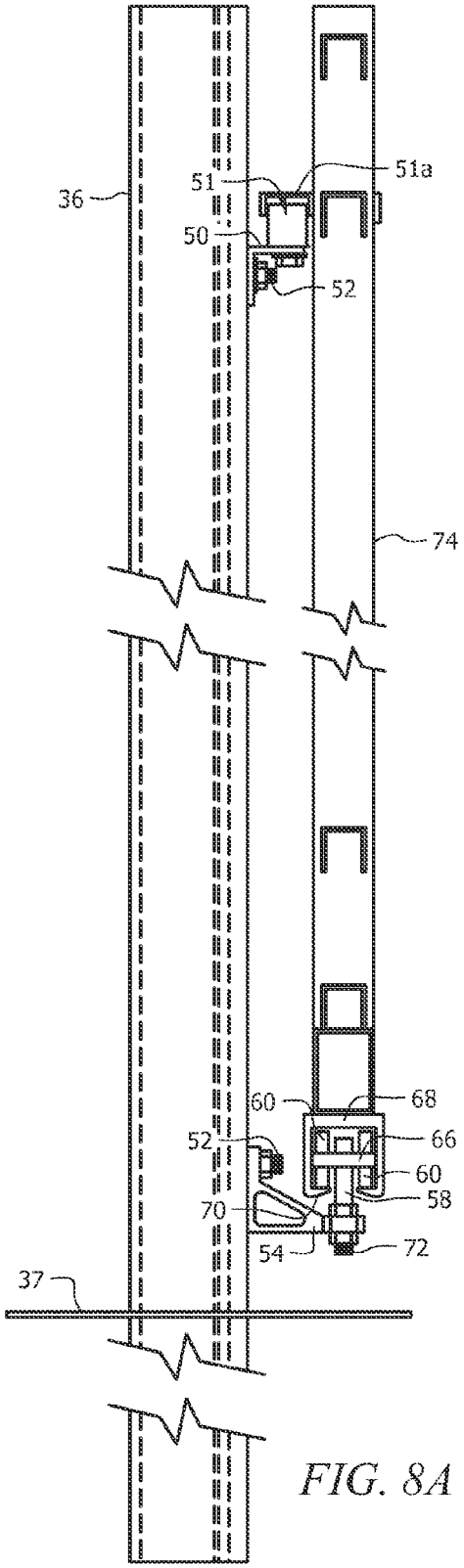
FIG. 8A is side elevational view of a third embodiment.
Figure 8B:
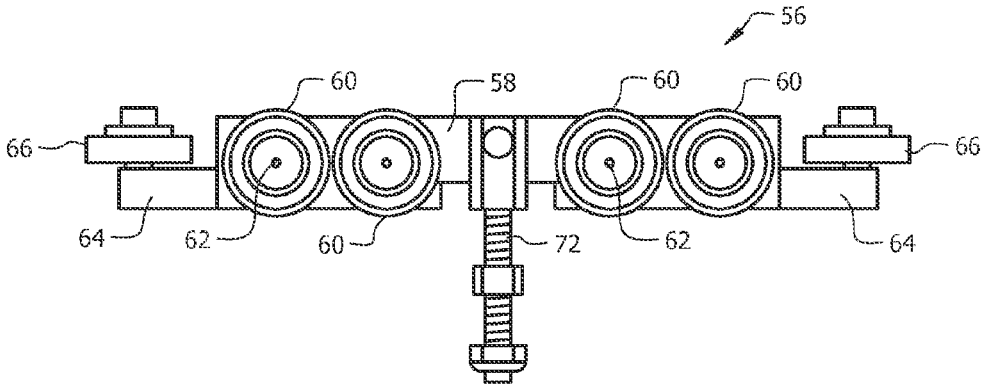
FIG. 8B is a front elevational view of a trolley apparatus of the third embodiment.
Figure 8C:
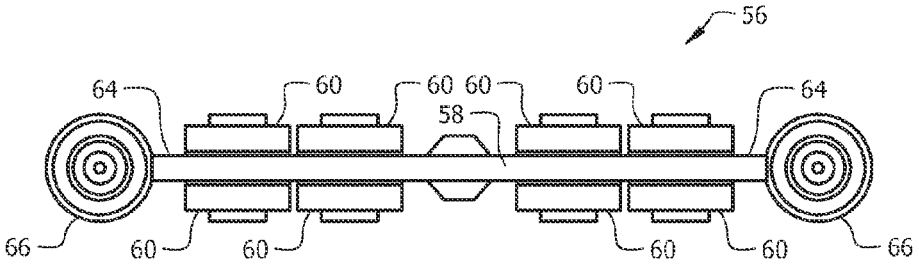
FIG. 8C is a top plan view of the trolley apparatus of FIG. 7B.

FIGS. 8A, 8B and 8C depict how novel post 36 can also be used in the construction of cantilever gates, i.e., gates that do not swing about hinges but which slide to the left or right.

Instead of bracket 10 having base plate 12 that is secured to post 36 by four (4) screws, in this third embodiment upper angle bracket 50 is secured to post 36 near an upper end thereof by two (2) laterally spaced apart screws 52, only one of which is depicted in the side elevational view of FIG. 8A. The nut associated with screw 52 is not numbered to avoid cluttering the drawing. Angle bracket 50 supports roller 51 that is housed by guide frame 51*a* that is secured to the cantilever gate.

Trolley bracket 54 is secured to a lower end of post 36 by two additional screws, also denoted 52 in the same way. A ground surface is denoted 37 in FIG. 8A. FIGS. 8B and 8C depict trolley assembly 56 in front elevational and top plan views, respectively.

Trolley assembly 56 includes elongate flat base plate 58 to which four pairs of rollers are mounted in this particular embodiment, it being understood that fewer or more rollers may be used for various applications and differing numbers of pairs of rollers are therefore within the scope of this invention. The paired rollers are collectively denoted 60.

As best understood by comparing FIGS. 8B and 8C with FIG. 8A, flat base plate 58 is oriented in a vertical plane, as are rollers 60 which rotate about associated horizontal axles, collectively denoted 62, which are disposed transversely to the longitudinal axis of symmetry of flat base plate 58.

Auxiliary wheel mounts, collectively denoted 64, are secured to and extend from opposite ends of flat base plate 58. Each wheel mount 64 supports a vertical axle and each vertical axle supports a horizontally mounted wheel 66.

Trolley assembly 56 is housed within elongate housing 68 (FIG. 8A) which includes inboard-turned flanges 70 upon which rollers 60 ride.

Flat base plate 58, vertical rollers 60 and horizontal rollers 66 are mounted to trolley bracket 54 by elongate screw 72 and a pair of nuts, not numbered to avoid clutter, that sandwich the horizontal part of trolley bracket 54 between them as depicted in FIG. 8A. Those nuts are also depicted but not numbered in the center of FIG. 8B as well.

Cantilever gate 74 is welded to the top wall of elongate trolley housing 68 as depicted in FIG. 8A. Accordingly, when gate 74 is displaced to the left or right (out of or into the plane of the paper as drawn), trolley housing 68 is conjointly displaced and rollers 60 and 66 rotate about their respective fixed-position axles upon inboard-turned flanges 70, to facilitate such gate displacement.

The number of trolley brackets 54 and trolley assemblies 56 and hence the number of T-slot posts 36 that must be used depends upon the length of the cantilever gate.

Roller 51 at the upper end of each post 36 also rotates when gate 74 is displaced but most of the weight of gate 74 is carried by trolley assembly 56 and said upper roller 51 is thus a guide or idler roller, there being one guide roller 51 for each post 36.

Accordingly, the novel apparatus includes three embodiments. The first two embodiments are used with swinging gates. In the first embodiment, the screws that mount the hinge to the novel T-slot gate post 36 are normal to the plane of a closed swinging gate, i.e., they are perpendicular to the plane of the paper as drawn. In the second embodiment, the screws that mount the novel T-slot gate post 36 to the hinge are parallel to the plane of a closed swinging gate, i.e., they are positioned in the plane of the paper as drawn. The third embodiment employs the novel cantilever T-slot gate post 36 in a cantilever-mounted, i.e., non-swinging gate.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An upstanding non-rotating post configured to be used with a gate having a hollow interior to which a base plate is mountable at any preselected position along the vertical extent of said upstanding post, comprising:

said post having a predetermined geometrical configuration in transverse section;

said post including a flat front wall;

said base plate having a flat structure that abuts said flat front wall;

said post having two vertical columns of solid material that are laterally spaced apart from one another, said two vertical columns being integral with said flat front wall of said post and extending into said hollow interior of said post;

said two vertical columns of solid material each including a respective T-shaped slot, each of said T-shaped slots extending the entire extent of said post and being in open communication with a top and a bottom end of said post;

each of said T-shaped slots adapted to receive a screw or bolt having tool-engageable head and a threaded stem, said head adapted to be received with a short crossbar of said T-shaped slot and said threaded stem adapted to be received within said long section of said T-shaped slot, and said T-shaped slot engaging a circumferential surface of said head to prevent rotation of said head;

said long section of said T-shaped slot having less extent than said long section of said threaded stem so that a distal free end of said threaded stem of said screw or bolt extends from said long section of said T-shaped slot;

said distal free end of said screw or bolt adapted to screw-threadedly engage a nut.

2. An upstanding non-rotating solid post configured to be used with a gate to which a base plate is mountable at any preselected position along the extent of said upstanding post, comprising:

said post having a predetermined geometrical configuration in transverse section;

said post including a flat front wall;

said base plate having a flat structure that abuts said flat front wall;

a pair of T-shaped slots formed in said post, said T-shaped slots being laterally spaced apart from one another extending the entire vertical extent of said post and being in open communication with a top and a bottom end of said post;

each of said T-shaped slots adapted to receive a screw or bolt having a tool-engageable head and a threaded stem, said head adapted to be received with a short section of said T-shaped slot and said threaded stem adapted to be received within a long section of said T-shaped slot, and said T-shaped slot engaging a circumferential surface of said head to prevent rotation of said head;

said long section of said T-shaped slot having less extent than a threaded stem of said screw or bolt so that a distal free end of said screw or bolt extends from said long section of said T-shaped slot; and said distal free end of said screw or bolt adapted to screw-threadedly engage a nut.

* * * * *